US009618908B2

(12) United States Patent
Clarkson et al.

(10) Patent No.: US 9,618,908 B2
(45) Date of Patent: Apr. 11, 2017

(54) WATCH DISPLAY USING LIGHT SOURCES WITH A TRANSLUCENT COVER

(71) Applicant: Nike, Inc., Beaverton, OR (US)

(72) Inventors: Brad N. Clarkson, Beaverton, OR (US); Bo Stefan Andren, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/258,324

(22) Filed: Apr. 22, 2014

(65) Prior Publication Data

US 2014/0226443 A1 Aug. 14, 2014

Related U.S. Application Data

(63) Continuation of application No. 14/192,482, filed on Feb. 27, 2014, now Pat. No. 9,201,405, which is a continuation of application No. 11/752,090, filed on May 22, 2007, now Pat. No. 8,780,675.

(60) Provisional application No. 60/802,637, filed on May 22, 2006.

(51) Int. Cl.

| | |
|---|---|
| ***G04G 17/04*** | (2006.01) |
| ***G04G 17/08*** | (2006.01) |
| ***G09F 9/33*** | (2006.01) |
| ***G09F 13/22*** | (2006.01) |
| ***G04G 21/00*** | (2010.01) |

(52) U.S. Cl.

CPC ..... *G04G 17/045* (2013.01); *G04G 17/08* (2013.01); *G04G 21/00* (2013.01); *G09F 9/33* (2013.01); *G09F 13/22* (2013.01)

(58) Field of Classification Search

CPC ..... G04G 17/045

USPC ..... 368/82, 83, 223, 241; 3/82, 83, 223, 241

See application file for complete search history.

(56) References Cited

U.S. PATENT DOCUMENTS

| | | | |
|---|---|---|---|
| 3,817,021 | A | 6/1974 | Bergey |
| 4,274,154 | A | 6/1981 | Dostoomian et al. |
| 4,571,682 | A | 2/1986 | Silverman et al. |
| 4,776,583 | A | 10/1988 | Jennings |
| 4,828,257 | A | 5/1989 | Dyer et al. |
| 4,867,442 | A | 9/1989 | Matthews |
| 4,919,418 | A | 4/1990 | Miller |

(Continued)

FOREIGN PATENT DOCUMENTS

| | | | |
|---|---|---|---|
| DE | 19955720 | A1 | 5/2001 |
| EP | 326668 | A2 | 8/1989 |

(Continued)

OTHER PUBLICATIONS

JP Notice of Reasons for Rejection for JP Application No. 2009-512265, mailed Jul. 25, 2011.

(Continued)

*Primary Examiner* — Amy Cohen Johnson
*Assistant Examiner* — Jason Collins
(74) *Attorney, Agent, or Firm* — Banner & Witcoff, Ltd.

(57) ABSTRACT

A display assembly includes a display selectively displaying human-readable indicia on a face thereof and a cover disposed over the display. The cover has a homogeneous surface over the entire face of the display. The display assembly is controllable between an inactive state and an active state. In the inactive state, the face of the display is not viewable through the cover, and in the active state, the indicia are viewable through the cover.

18 Claims, 7 Drawing Sheets

(56) References Cited

U.S. PATENT DOCUMENTS

| | | | | |
|---|---|---|---|---|
| 5,089,960 | A | 2/1992 | Sweeney, Jr. | |
| 5,213,555 | A | 5/1993 | Hood et al. | |
| 5,466,200 | A | 11/1995 | Ulrich et al. | |
| 5,547,439 | A | 8/1996 | Rawls et al. | |
| 5,645,509 | A | 7/1997 | Brewer et al. | |
| 5,655,997 | A | 8/1997 | Greenberg et al. | |
| 5,759,043 | A | 6/1998 | Craig | |
| 5,785,632 | A | 7/1998 | Greenberg et al. | |
| 5,787,054 | A | 7/1998 | Yasukawa et al. | |
| 5,799,652 | A | 9/1998 | Kotliar | |
| 5,890,995 | A | 4/1999 | Bobick et al. | |
| 5,890,997 | A | 4/1999 | Roth | |
| 5,899,963 | A | 5/1999 | Hutchings | |
| 5,904,639 | A | 5/1999 | Smyser et al. | |
| 5,916,063 | A | 6/1999 | Alessandri | |
| 5,921,891 | A | 7/1999 | Browne | |
| 6,000,842 | A * | 12/1999 | Muller et al. | 368/319 |
| 6,013,007 | A | 1/2000 | Root et al. | |
| 6,027,428 | A | 2/2000 | Thomas et al. | |
| 6,050,924 | A | 4/2000 | Shea | |
| 6,058,932 | A | 5/2000 | Hughes | |
| 6,059,576 | A | 5/2000 | Brann | |
| 6,059,692 | A | 5/2000 | Hickman | |
| 6,066,075 | A | 5/2000 | Poulton | |
| 6,188,927 | B1 | 2/2001 | Lu et al. | |
| 6,287,239 | B1 | 9/2001 | Hernandez | |
| 6,464,618 | B1 | 10/2002 | Shea | |
| 6,621,766 | B2 | 9/2003 | Brewer et al. | |
| 6,638,198 | B1 | 10/2003 | Shea | |
| 6,678,215 | B1 * | 1/2004 | Treyz et al. | 368/10 |
| 6,702,720 | B2 | 3/2004 | Dardik | |
| 6,736,759 | B1 | 5/2004 | Stubbs et al. | |
| 6,749,537 | B1 | 6/2004 | Hickman | |
| 6,865,835 | B1 | 3/2005 | Webster | |
| 6,921,351 | B1 | 7/2005 | Hickman et al. | |
| 7,079,452 | B2 | 7/2006 | Harrison | |
| 7,441,931 | B2 | 10/2008 | Bayersdorfer et al. | |
| 2003/0026171 | A1 | 2/2003 | Brewer et al. | |
| 2004/0102931 | A1 | 5/2004 | Ellis et al. | |
| 2006/0251365 | A1 * | 11/2006 | Brewer | 385/116 |

FOREIGN PATENT DOCUMENTS

| | | | |
|---|---|---|---|
| EP | 1101511 | A2 | 5/2001 |
| JP | S52-149677 | | 11/1977 |
| JP | S61102582 | U | 6/1986 |
| JP | H03-030890 | | 3/1991 |
| JP | H03-030892 | | 3/1991 |
| JP | H01090399 | | 3/1992 |
| JP | 07051450 | | 2/1995 |
| JP | 09-62207 | | 3/1997 |
| JP | 2002-72933 | | 3/2002 |
| JP | 2002072933 | A | 3/2002 |
| JP | 2002149094 | A | 5/2002 |
| JP | 2005-208821 | A | 8/2005 |
| JP | 2005238349 | A | 9/2005 |
| JP | 2006033220 | A | 2/2006 |
| JP | 2007-051965 | | 3/2007 |
| JP | 2007051965 | A | 3/2007 |
| WO | 2001088636 | A1 | 11/2001 |
| WO | 2006033317 | A1 | 3/2006 |

OTHER PUBLICATIONS

CN Office Action (English translation) for CN Application No. 2012010900591220 mailed Jan. 12, 2012.

JP Office Action (English translation) for JP Application No. 2009-512265, mailed Feb. 20, 2012.

CN Office Action (English translation) for Application No. 200780022671.6, mailed Sep. 4, 2012.

EP Examination Report from EP Application No. 07797655.3, mailed May 17, 2011.

CN Office Action for Application No. 200780022671.6, mailed May 5, 2010.

EP Office Action dated Jan. 11, 2010 for EP Application No. 07797655.3.

IPRP (Chapter 1) from PCT Application No. PCT/US2007/069474, mailed Nov. 2, 2008.

Health Care, High-Tech Style, by Bernard Wyskocki, Jr., The Wall Street Journal, Apr. 17, 2001, 2 pgs.

Printout of Web page (Netpulse Frequent Fitness Program), dated 1213199, 3 pgs.

Printout of Web page from Interactive Fitness Technologies, Inc. (UltraCoach Standard), dated Nov. 30, 1999, 3 pgs.

Printout of Web page from Interactive Fitness Technologies, Inc. (UltraCoach Multi-Sport Training Software Products Catalog), dated Sep. 1999, 12 pgs.

Printout of Web page from Interactive Fitness Technologies, Inc. (UltraCoach VR: How it Works?), dated Nov. 30, 1999, 2 pgs.

Printout of Web page from Interactive Fitness Technologies, Inc. (UltraCoach VR Features), dated Nov. 30, 1999, 3 pgs.

Printout of Web page from Interactive Fitness Technologies, Inc. (UltraCoach Fit Software Comparisons), dated 11130199, 2 pgs.

Printout of Web page from Interactive Fitness Technologies, Inc. (UltraCoach Home Page), dated Nov. 30, 1999, 2 pgs.

* cited by examiner

WATCH DISPLAY USING LIGHT SOURCES WITH A TRANSLUCENT COVER

CROSS-REFERENCE TO RELATED APPLICATIONS

This application is a continuation of U.S. patent application Ser. No. 14/192,482 filed Feb. 27, 2014, which is a continuation of U.S. patent application Ser. No. 11/752,090 filed May 22, 2007, which is a non-provisional of and claims priority to U.S. Provisional Patent Application No. 60/802,637 filed May 22, 2006, which application is incorporated herein by reference and made a part hereof.

FIELD OF THE INVENTION

The present invention relates to a display, such as for an electronic device. Various examples of the invention are particularly useful for a watch display.

BACKGROUND

Prior displays and display assemblies have certain disadvantages and limitations. Consumer demand exists for watches and other electronic display assemblies having aesthetic appearances and functionalities that are unique and different from existing watches. Additionally, many existing watches and other electronic display assemblies do not provide sufficient water resistance.

The present invention is provided to solve the problems discussed above and other problems, and to provide advantages and aspects not provided by prior display assemblies of this type. A full discussion of the features and advantages of the present invention is deferred to the following detailed description, which proceeds with reference to the accompanying drawings.

SUMMARY OF THE INVENTION

Various aspects of the invention relate to a display assembly that includes a display selectively displaying human-readable indicia on a face thereof and a cover disposed over the display. The cover has a generally homogeneous surface over the entire face of the display. The display assembly is controllable between an inactive state and an active state. In the inactive state, the indicia are not viewable through the cover, and in the active state, the indicia are viewable through the cover.

According to one aspect, the cover has a thinned portion, having a thickness substantially less than a thickness of an adjacent portion of the cover. The thinned portion is positioned over the face of the display to permit viewing of the indicia when the assembly is in the active state.

According to another aspect, the cover has a translucent portion and an opaque portion. The translucent portion is positioned over the face of the display to permit viewing of the indicia when the assembly is in the active state.

According to a further aspect, the display has one or more light-emitting devices to produce the indicia. The cover has one or more conduits, each of the conduits being substantially aligned with each of the light-emitting devices.

According to still further aspects, the display is integrated into an electronic display module containing a computer component. The homogeneous surface has contours defining buttons thereon. Each button is operatively coupled to the display module to interact with the computer component. In one aspect, the computer component is configured to communicate with and control a separate electronic device.

Other aspects of the invention relate to a band, such as for use with a display assembly as described above. In one aspect, the band includes a strap operatively connected to the display, a holder having a cavity for receiving a display module, and a cover as described above. The strap is adapted to mount the assembly on a body of a user. The strap may be made of the same material as the cover and/or the holder, and the strap, the cover, and the holder may be formed of a single, integral piece.

BRIEF DESCRIPTION OF THE DRAWINGS

To understand the present invention, it will now be described by way of example, with reference to the accompanying drawings in which.

DETAILED DESCRIPTION

Figure 1:
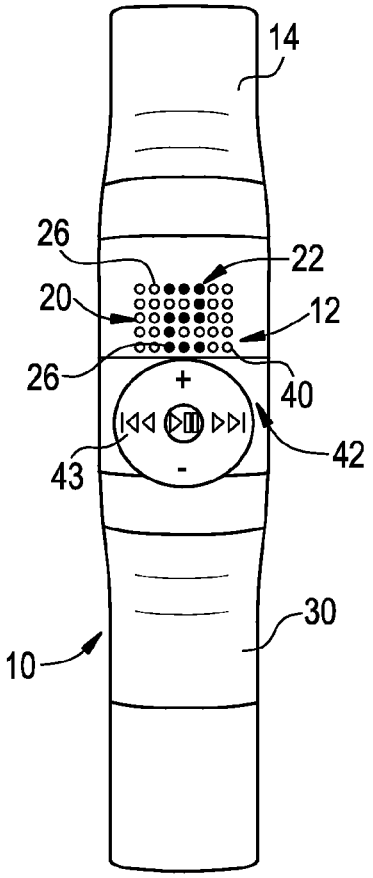
FIG. 1 is a planar top view of an electronic display assembly according to various examples of the invention, shown in an active state.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the FIGS., and initially to FIGS. 1-5, there is shown an electronic display assembly 10 that generally includes a display module 12 and a band 14 adapted to be mounted on the body of a user. The display module 12 includes a display 20 selectively displaying human-readable indicia 22 on a face 24 thereof. In the embodiment shown, the display assembly 10 is a wristwatch, and the band 14 contains a strap 30 and a clasp or buckle 32 for securing the display assembly 10 to the wrist or arm of a user.

In the embodiment shown in the FIGS., the display module 12 is an electronic display module, and may contain a computer component. For example, the display module 12 of the assembly 10 may contain one or more computer components to perform the functions of a watch, such as incrementing time intervals to maintain a current time and date, as well as performing stopwatch functions and other functions. In another embodiment, the display module 12 may contain computer components configured to store and play audio files. In further embodiments, the display module 12 may contain computer components for performing other functions. Additionally, the display module 12 may be configured to create other output in addition to the indicia, and may have communication components, including wired and/or wireless communication components. For example, in one embodiment, the display module 12 includes one or more computer components for communicating with and controlling another electronic device. As shown in FIGS. 1-6, in some embodiments, the assembly 10 has buttons 43, 52 for wirelessly controlling an audio player. The buttons 43, 52 are described in more detail below. It is understood that these buttons 43, 52 may be assigned certain functions, and that a single button may have multiple functions based on button pressing technique, including sequence and length of pressing the buttons 43, 52. Still further, the display module 12 can include functionality relating to receiving and displaying data received from a shoe-mounted sensor, such as running speed and distance.

As stated above, the display 20 of the display module 12 has a face 24 that selectively displays human-readable indicia 22, for example, the numerical indicia 22 shown in FIG. 1 that displays the number "2". When the display module 12 is incorporated into a watch, the indicia 22 may include time and date indicia, in addition to other indicia. It is understood that the display 20 may be configured to display a number of different types of indicia, and the nature of the information displayed may influence the type of indicia displayed. Additionally, the display 20 may include any of a number of different devices for displaying the indicia 22. In one exemplary embodiment, the display 20 includes one or more light-emitting devices 26 to display the indicia, conveying information to the user, such as light-emitting diodes (LED's) or electroluminescent materials applied to a powered substrate, for example. Of course, any desired light emitting device may be used with alternate examples of the invention, such as incandescent or fluorescent lights. In the embodiment shown in FIGS. 1-7, the light-emitting devices 26 include thirty-five LED's 26 that selectively emit light to form readable indicia 22. The display 20 can be controllable between an inactive state, where the indicia are not viewable, and an active state, wherein the indicia are viewable. For example, in the display 20 as shown in FIGS. 1-7, the LED's may be lit in the active state and may not be lit in the inactive state.

Figure 2:
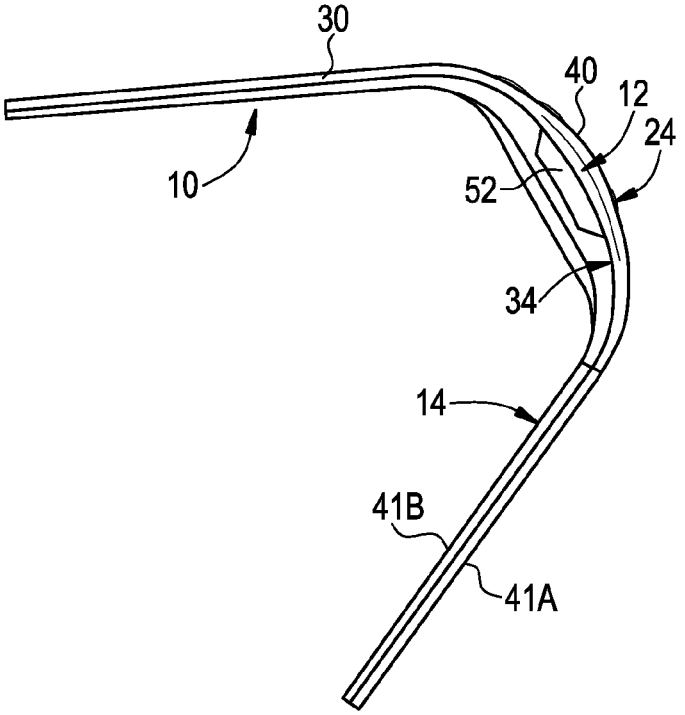
FIG. 2 is a planar side view of the electronic display assembly illustrated in FIG. 1.
Figure 3:
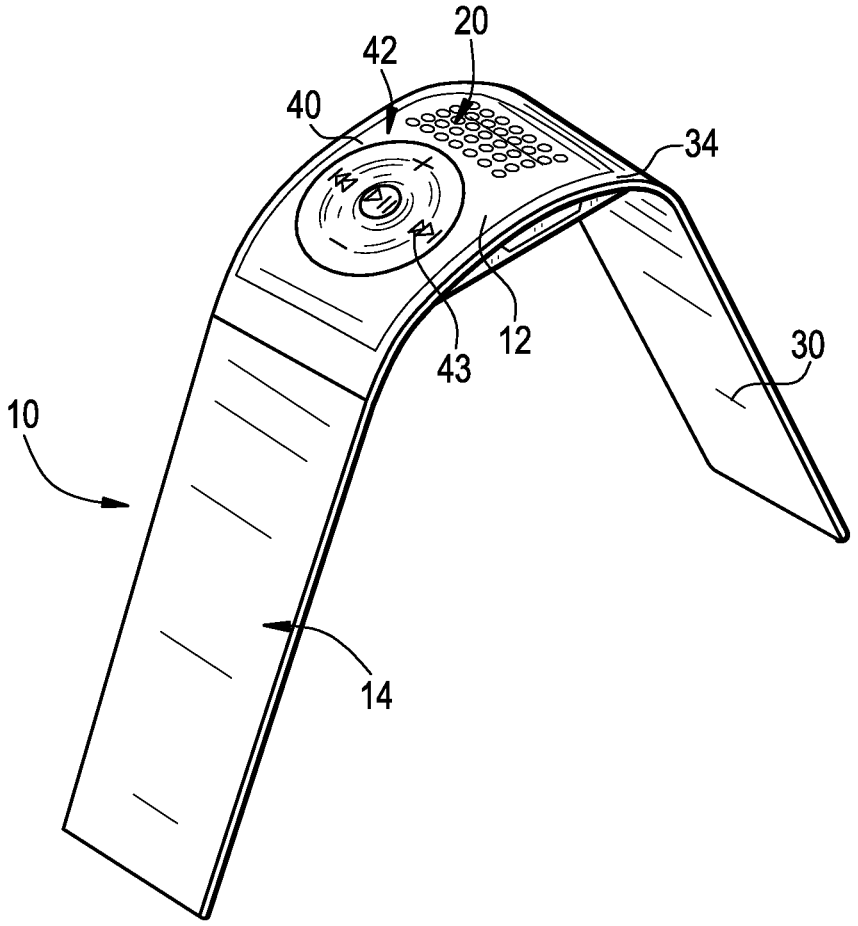
FIG. 3 is a top perspective side view of the electronic display assembly illustrated in FIG. 1.
Figure 4:
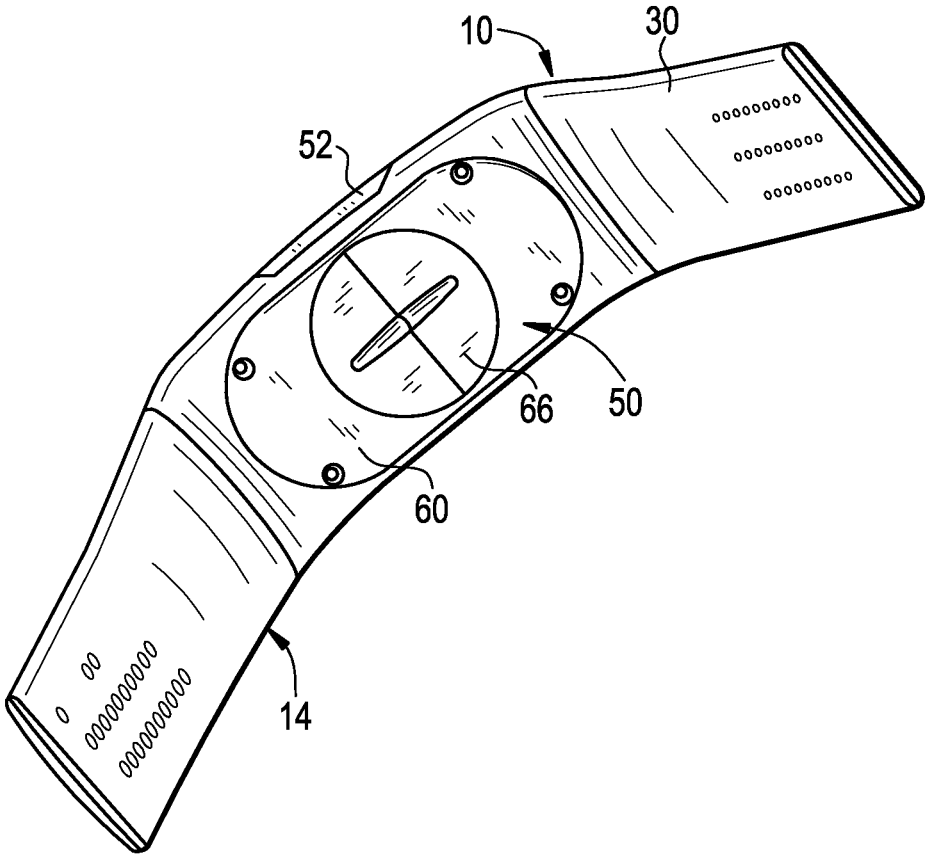
FIG. 4 is a bottom perspective side view of the electronic display assembly illustrated in FIG. 1.
Figure 5:
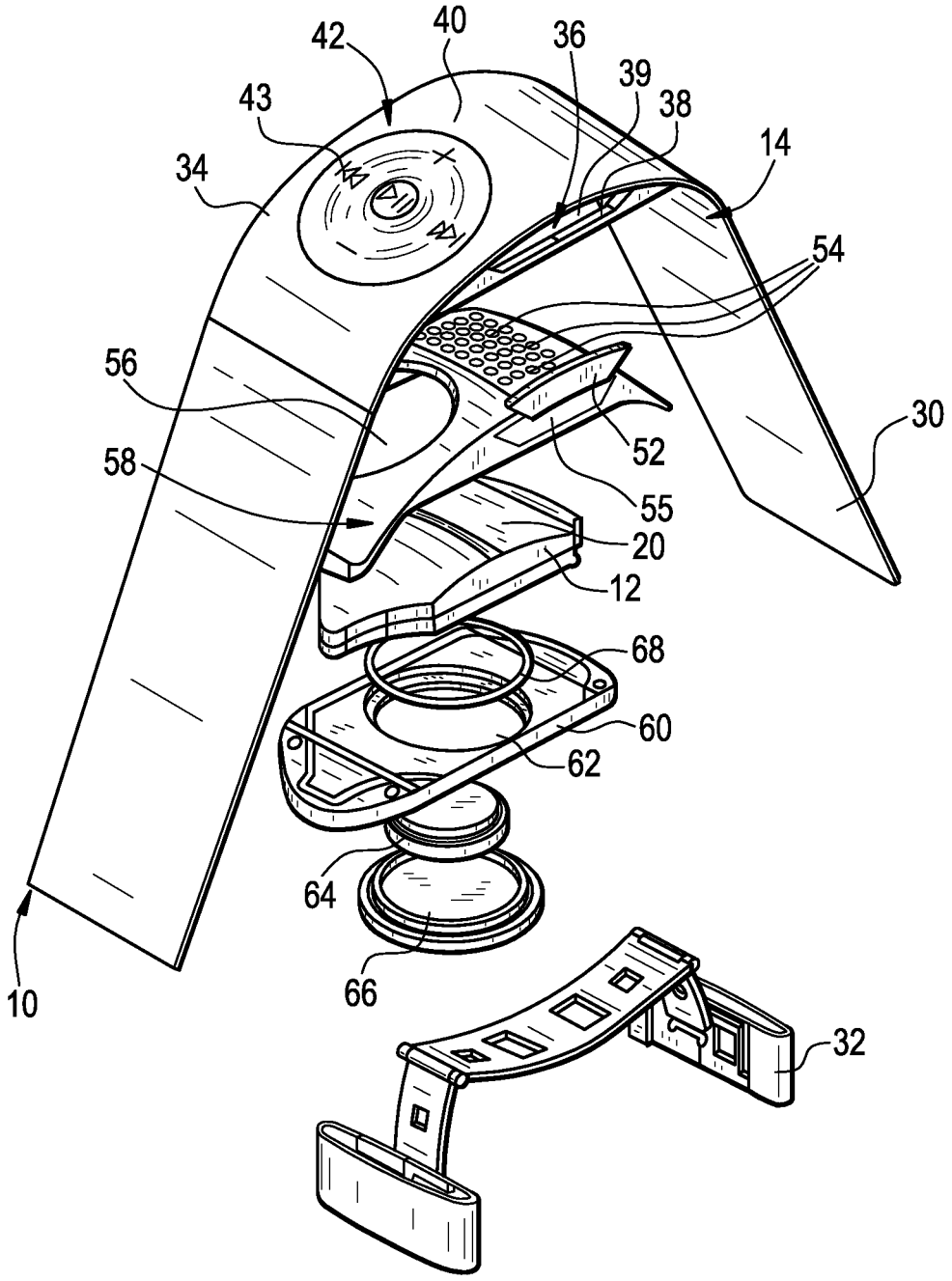
FIG. 5 is an exploded perspective view of the electronic display assembly illustrated in FIG. 1.
Figure 6:
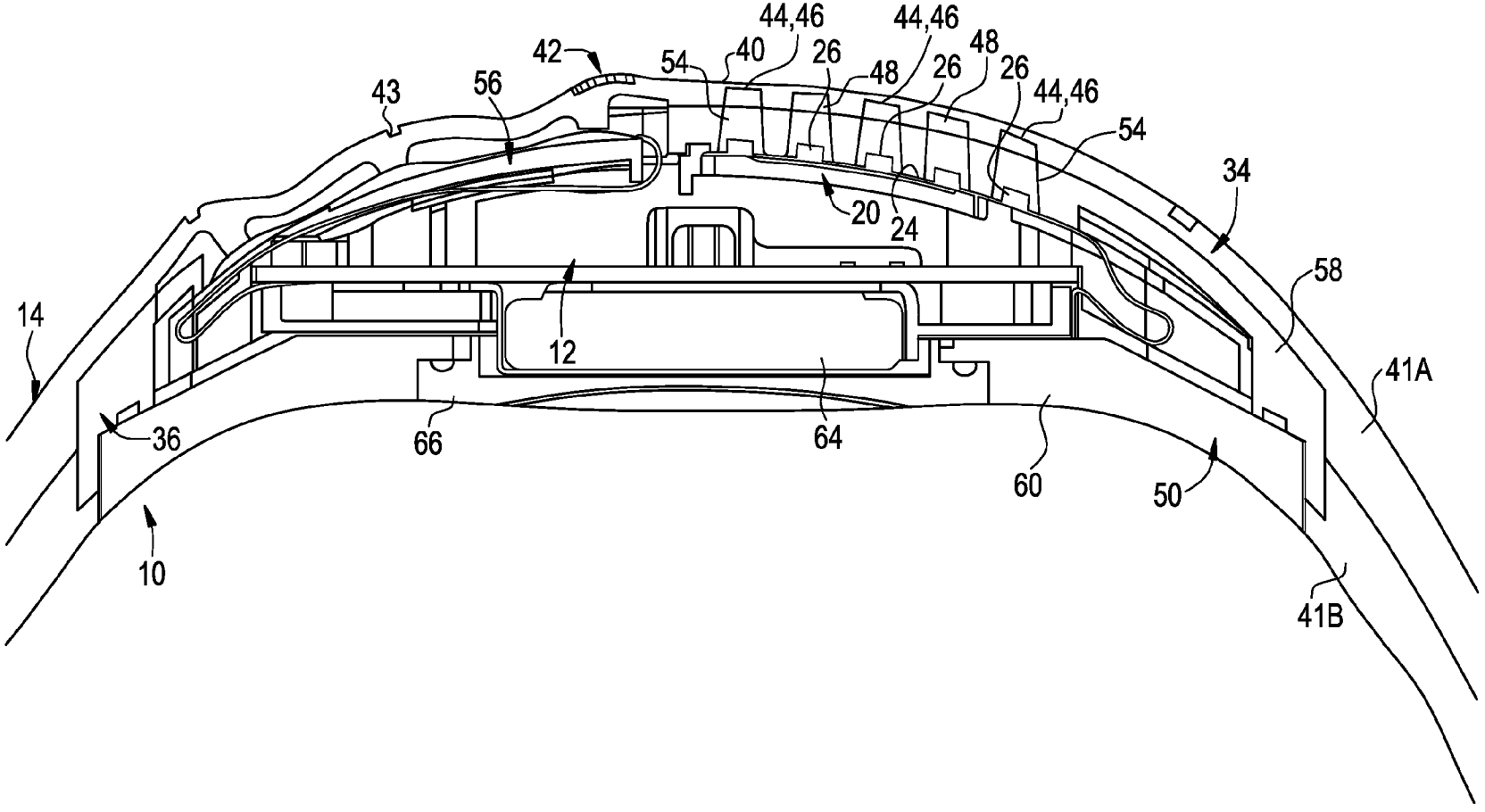
FIG. 6 is a planar cross-section view of the electronic display assembly illustrated in FIG. 1.

In the embodiment shown in FIGS. 1-7, the band 14 includes a holder 34 for holding the display module 12 and a strap 30 for attachment to the body of a user. The band 14 may also include a clasp or buckle 32 attached to the strap 30 for fastening purposes. The holder 34 can include a cavity 36 designed to receive the display module 12 therein. In one exemplary embodiment, the band 14 defines a cover 40 that is disposed over the face 24 of the display 20. In the embodiment shown in FIGS. 1-7, the cover 40 is disposed over the entire face 24 of the display 20, covering not only the light-emitting devices 26, but the entire surface on which the display 20 is positioned. The cover 40 provides a display having a homogeneous surface 42, rather than the heterogeneous surface that is common with prior displays. Homogeneous, as used herein, means that the surface 42 has substantially consistent characteristics over the substantial entirety of the surface 42. For example, the surface 42 in the embodiment shown in FIGS. 1-6 has visually consistent characteristics and texturally consistent characteristics over the substantial entirety of the surface 42. The surface 42 may have other or additional consistent characteristics as well. In one embodiment, the holder 34 and strap 30 are made of the same material, and in the embodiment shown in FIGS. 1-7, the holder 34 and strap 30 are formed of a single, integral piece. Similarly, the cover 40 and strap 30 may be made of the same material, and may be formed of a single, integral piece, providing a cover 40 with a homogeneous surface 42. In one embodiment, the cover 40, the holder 34, and the strap 30 are made from a flexible polymer material, such as polyurethane or another polymer material. In one embodiment, the flexible material is sufficiently flexible to be bent to an angle greater than 90 degrees without permanent deformation or fracture of the material. As shown in FIGS. 2 and 6, the band 14 may be made from a from a two-layer "double-shot" polymer, such as having two layers 41A, 41B made from different colors of polyurethane. The cover 40 also provides a smoothly curved contour to the surface 42 over the display 20.

In the embodiment shown in FIGS. 1-7, the display 20 is selectively viewable through the cover 40. When the display 20 is in the inactive state, the face 24 of the display is not viewable through the cover 40 because the cover 40 covers and obscures the face 24. When the display 20 is in the active state, the active (lit) LED's are viewable through the cover 40, making the indicia 22 viewable through the cover 40.

In one exemplary embodiment, the cover 40 is generally opaque, and has a translucent portion 44 positioned over the display 20. This translucent portion 44 effectively obscures the display 20 when the display 20 is in the inactive state, but is sufficiently permittive to light in order to allow the light emitting device(s) 26 to be viewable when the display 20 is in the active state. In another embodiment, the cover 40 has a thickness, and has a thinned portion 46 positioned over the display 20. This thinned portion 46 effectively obscures the display 20 when the display 20 is in the inactive state, but is sufficiently thin to allow the light emitting device(s) 26 to be viewable when the display 20 is in the active state. In the embodiment shown in FIGS. 6 and 7, the thinned portion 46 has a thickness substantially less than the thickness of an adjacent portion of the cover 40.

Figure 7:
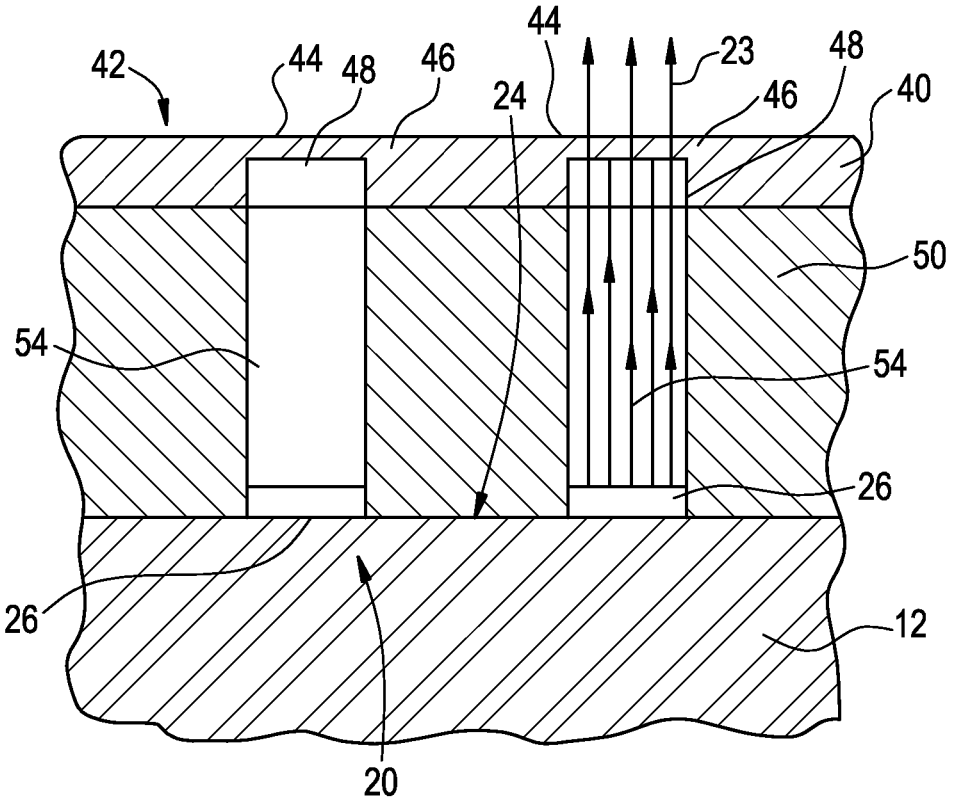
FIG. 7 is a focused partial cross-section view of the electronic display assembly illustrated in FIG. 1.
Figure 8:
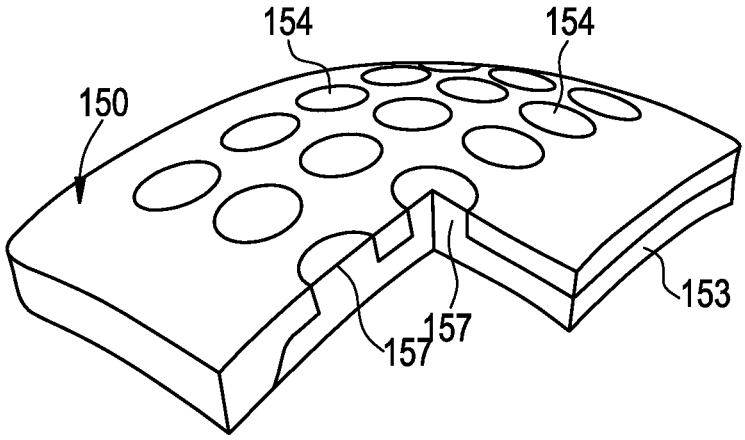
FIG. 8 is a perspective cross-sectional view of a portion of a shell of one embodiment of a display assembly according to various examples of the invention.
Figure 9:
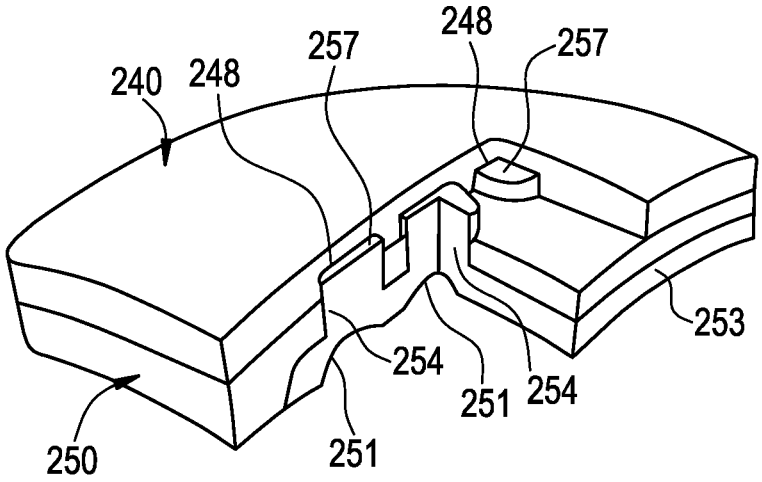
FIG. 9 is a perspective cross-sectional view of a portion of a shell and a cover of another embodiment of a display assembly according to various examples of the invention.

In one exemplary embodiment, as illustrated in FIGS. 6 and 7, the cover 40 contains a plurality of conduits 48 extending through a portion of the thickness of the cover 40, with the plurality of conduits 48 creating a plurality of discrete thinned portions 46. In one embodiment, the conduits 48 extend close to the surface 42 of the cover 40 so that the thickness of the cover at each conduit is approximately 0.4 mm. The small thickness of the thinned portions 46 results in the thinned portions 46 being translucent. Each conduit 48 is substantially aligned with one of the LED's 26 of the display 20, so that when the display 20 is in the active state, light emitted by each LED 26 travels through the corresponding conduit 48 to be viewable through the cover 40. The passage of light rays 23 through the conduit 48 and the cover 40 from an active light emitting device 26 is depicted in FIG. 7. The conduits 48 may be tapered in order to more effectively channel or funnel light to the surface of the cover 40. It is understood that, in other embodiments, the cover 40 may contain one or more larger thinned and/or transparent portions. For example, the display may have a plurality of LED's, and a single thinned and/or transparent area may encompass a number of the LED's, or in one example, may encompass all of the LED's. In one embodiment, the conduits 48 convey light from one location to another, while minimizing diffusion and/or attenuation of the light between the two locations. The conduits 48 shown in FIGS. 6 and 7 are hollow; however, in other embodiments of the invention, each conduit 48 may be filled with a filling material or insert. For example, the conduits 48 may include a flexible fiber optic cable, a glass rod, or a clear plastic filling or insert, as illustrated in FIGS. 8 and 9, and described in greater detail below. In a further embodiment, all or a portion of the band 14, including all or a portion of the cover 40, could be manufactured from a transparent or translucent material, to allow transmission of light therethrough.

In the embodiment shown in FIGS. 1-7, the surface 42 of the cover 40 has several buttons 43 thereon. The buttons 43 are adapted to interact with the display module 12, such as to control and/or operate the display module 12. The buttons 43 may have indicia thereon to indicate the function of each button 43. The holder 34 of the band 14 may also have side flaps 38 extending downward from the edges of the cover 40, and each side flap 38 has an aperture 39 to provide access to additional buttons 52, as described below and shown in FIGS. 2 and 5.

The display assembly 10 shown in FIGS. 1-7 has a rigid shell or case 50 disposed between the display module 12 and the cover 40. More particularly, the shell 50 is formed around the display module 12 and is also received in the cavity 36 to help hold the display module 12 within the cavity 36. In one embodiment, the shell 50 is connected to the band 14 by a sealing technique to seal the module 12 within the cavity 36, providing water resistance. The shell 50 may also include a front piece 58 and a back piece 60 that cooperate to form the shell 50 holding the display module 12. In one embodiment, as illustrated in FIG. 5, the back piece 60 has an aperture 62 for access to the display module 12 to install and remove a battery 64. A battery cover 66 can be attached to the back piece 60 to close the aperture 62, and a gasket 68 may be positioned in or around the aperture 62 for sealing purposes. In one exemplary embodiment, the front piece 58 is made from a polymer, such as polycarbonate, and the back piece 60 and battery cover 66 are made from stainless steel. In other embodiments, the components of the shell 50 may be made from other materials. Additionally, some or all of the plastic components of the shell 50 may be made from a two-layer "double-shot" polymer, such as polycarbonate with a thin outer layer of polyurethane.

The shell 50 may also have buttons 52 thereon that are adapted to interact with the display module 12 to control or operate the display module 12. The buttons 52 are positioned in recesses 55 in the shell 50, and are accessible through the apertures 39 in the band 14. Likewise, the shell 50 has a window 56 to allow the buttons 43 of the cover 40 to access the display module 12. In the embodiment shown, the buttons 52 are formed of a two-layer "double-shot" polymer.

In order for the indicia 22 to be visible through the cover 40, such a shell 50 must not obscure or obstruct the light emitted from the light emitting device(s) 26. As shown in FIGS. 5-7, the front piece 58 of the shell 50 has a plurality of conduits 54, with each conduit 54 corresponding to one of the conduits 48 of the cover 40. Thus, in the embodiment shown, the light from each LED 26 travels through the conduit 54 of the shell 50 and through the corresponding conduit 48 in the cover 40 to be viewable through the cover 40. The conduits 48, 54 may be considered to collectively define a single conduit operably associated with a light-emitting device 26 (such as an LED 26), wherein light travels through the conduit to provide indicia 22 that is viewable through the cover 40 in the active state.

In one embodiment, as illustrated in FIGS. 5-7, these conduits 54 are hollow. However, it is understood that the conduits 54 may be filled with a material, such as an insert, as similarly described with respect to the conduits 48 of the cover 40. FIG. 8 illustrates one such embodiment of a shell 150 having conduits 154 filled with a transparent filling 157. In this embodiment, the filling 157 is flush with the surface of the shell 150 and does not extend into a cover (not shown) disposed over the shell 150. Additionally, the fillings 157 shown are interconnected to form a layer 153 of the filling material below the shell 150. FIG. 9 illustrates another such embodiment of a shell 250 having conduits 254 filled with a transparent filling 257. In this embodiment, the filling 257 extends into conduits 248 in the cover 240 disposed over the shell 250, filling at least a portion of the conduits 248. This configuration allows better localized penetration of light into the material of the cover 240. In this embodiment, the fillings 257 shown are interconnected to form a layer 253 of the filling material below the shell 250, and the layer 253 has recesses 251 below each conduit 254, improving light gathering from each light emitting device (not shown).

In some embodiments, these transparent fillings 157, 257 are made from plastic and can be manufactured using a "double shot" technique. Additionally, in some embodiments, the fillings 157, 257 may not be interconnected, and may not form a layer 153, 253. The fillings 157, 257 can improve light transmission and also serve to protect the electronic components of the display module 12 when used in a display assembly 10 as shown in FIGS. 1-6. In particular, if the thinned portions 46 are broken or torn, the fillings 157, 257 will prevent penetration of foreign objects and/or moisture into the display module 12.

In further embodiments, the front piece 58 may have a larger window or other structure for allowing light to pass through the shell 50, similar to the window 56. Alternately, the entire shell 50, or the front piece 58 thereof, may be molded out of transparent material to allow passage of light therethrough, provided that the leakage or bleeding away of light from the light emitting device 26 is sufficiently controlled.

The various embodiments of the display assembly 10 described herein provide advantages over existing display assemblies, including watches and other electronic devices. For example, the single-piece band and tightly-sealed case provide water resistance. Additionally, the homogenous surface of the cover and the ability to read the display through the cover provide an easily readable display and a pleasing aesthetic appearance. Thus, the display assembly 10 provides an aesthetic appearance such as in the form of an athletic flexible wristband, while at the same time providing functionality such as in the form of a watch, stopwatch, and/or a digital music player or controller therefor. Still other advantages and benefits would be apparent to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "front," "back," etc., as used herein, are intended for illustrative purposes only and do not limit the embodiments in any way. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A display assembly comprising:

a band having a top portion and curved sides configured to wrap around a wrist or arm of a user to permit the assembly to be worn by the user;

an electronic module comprising a computer component and configured for wireless communication with an external device, the electronic module further comprising a plurality of light-emitting devices forming a display controlled by the computer component and configured for selectively displaying human-readable indicia, the display being operable between an active state and an inactive state, wherein each of the light-emitting devices is configured to emit light when in the active state;

a cover comprising a flexible material disposed over a face of the display and covering all of the plurality of light-emitting devices, such that the flexible material forms an outermost surface of the display assembly, wherein the flexible material is sufficiently flexible to be bent to an angle of greater than 90 degrees without permanent deformation or fracture, the flexible material having an outer surface and an inner surface opposite the outer surface, the cover further having a first plurality of conduits extending from the inner surface of the cover toward the outer surface through a portion of a thickness of the cover, wherein the first plurality of conduits are spaced from each other on the cover, and wherein each of the first plurality of conduits is substantially aligned with one of the plurality of light-emitting devices; and a rigid shell positioned between the face of the display and the inner surface of the cover, the shell comprising a front piece and a back piece configured to form an enclosure configured to hold the electronic module, wherein the shell includes a second plurality of conduits spaced from each other on the shell, such that each of the second plurality of conduits corresponds to one of the first plurality of conduits and the flexible material covers all of the second plurality of conduits, and wherein a filling material is provided within a portion of each of the second plurality of conduits, wherein the filling material provided within a portion of each of the second plurality of conduits is interconnected, such that a layer of filling material is formed below an inner surface of the front piece of the shell, and wherein the filling material forms spaced columns extending from the layer of filling material into the second plurality of conduits.

2. The display assembly of claim 1, wherein the shell is configured to permit a portion of the light emitted from each light-emitting device in the active state to pass through, such that light emitted from one of the light-emitting devices travels through one of the corresponding second plurality of conduits and one of the first plurality of conduits, allowing the display to be visible through the cover when the light-emitting devices are in the active states.

3. The display assembly of claim 1, wherein the front piece of the shell includes the second plurality of conduits.

4. The display assembly of claim 1, wherein the filling material is selected from the group of: a flexible fiber optic cable, a glass rod, and a clear plastic filling.

5. The display assembly of claim 1, wherein the filling material is provided within the entirety of each of the second plurality of conduits, such that the filling material is flush with the inner surface of the cover.

6. The display assembly of claim 1, wherein the filling material extends past the inner surface of the cover, such that a portion of each of the first plurality of conduits contains the filling material.

7. The display assembly of claim 1, wherein the external device comprises an audio player.

8. A display assembly comprising:

a band having a top portion and curved sides configured to wrap around a wrist or arm of a user to permit the assembly to be worn by the user;

a display comprising a plurality of light-emitting devices and configured for selectively displaying human-readable indicia, the display being operable between an active state and an inactive state, wherein each of the light-emitting devices is configured to emit light when in the active state;

a cover comprising a flexible material disposed over a face of the display and covering all of the plurality of light-emitting devices, such that the flexible material forms a single, homogenous surface that covers the entire display and extends over the top portion and around the sides of the band, wherein the flexible material is sufficiently flexible to be bent to an angle of greater than 90 degrees without permanent deformation or fracture, the flexible material having an outer surface and an inner surface opposite the outer surface, the cover further having a first plurality of conduits extending from the inner surface of the cover toward the outer surface through a portion of a thickness of the cover, wherein the first plurality of conduits are spaced from each other on the cover, and wherein each of the first plurality of conduits is substantially aligned with one of the plurality of light-emitting devices; and a rigid shell positioned between the face of the display and the inner surface of the cover, the shell comprising a front piece and a back piece configured to form an enclosure configured to hold the display, wherein the front piece of the shell includes a second plurality of conduits spaced from each other on the shell, such that each of the second plurality of conduits corresponds to one of the first plurality of conduits and the flexible material covers all of the second plurality of conduits, the shell further having a button configured to interact with the display and to provide control operations to the display, and wherein a filling material is provided within a portion of each of the second plurality of conduits, wherein the filling material provided within a portion of each of the second plurality of conduits is interconnected, such that a layer of filling material is formed below an inner surface of the front piece of the shell, and wherein the filling material forms spaced columns extending from the layer of filling material into the second plurality of conduits.

9. The display assembly of claim 8, wherein the filling material is selected from the group of: a flexible fiber optic cable, a glass rod, and a clear plastic filling.

10. The display assembly of claim 8, wherein the filling material is provided within the entirety of each of the second plurality of conduits, such that the filling material is flush with the inner surface of the cover.

11. The display assembly of claim 8, wherein the filling material extends past the inner surface of the cover, such that a portion of each of the first plurality of conduits contains the filling material.

12. A device comprising:

a band configured to wrap around a wrist or arm of a user to permit the device to be worn by the user;

an electronic module comprising a computer component and configured for wireless communication with an external device, the electronic module further comprising a plurality of light-emitting devices forming a display controlled by the computer component and configured for selectively displaying human-readable indicia, the display being operable between an active state and an inactive state, wherein each of the light-emitting devices is configured to emit light when in the active state;

a cover comprising a flexible material disposed over the display and covering all of the plurality of light-emitting devices, wherein the flexible material is sufficiently flexible to be bent to an angle of greater than 90 degrees without permanent deformation or fracture, the flexible material having an outer surface and an inner surface opposite the outer surface, the cover further having a first plurality of conduits extending from the inner surface of the cover toward the outer surface through a portion of a thickness of the cover, wherein the first plurality of conduits are spaced from each other on the cover, and wherein each of the first plurality of conduits is substantially aligned with one of the plurality of light-emitting devices; and a rigid shell positioned between a face of the display and the inner surface of the cover, the shell comprising a front piece and a back piece, wherein the front piece of the shell includes a second plurality of conduits spaced from each other on the shell, such that each of the second plurality of conduits corresponds to one of the first plurality of conduits and the flexible material covers all of the second plurality of conduits, wherein a filling material is provided within a portion of each of the second plurality of conduits, and wherein the shell is configured to permit a portion of the light emitted from each light-emitting device in the active state to pass through, such that light emitted from one of the light-emitting devices travels through one of the corresponding second plurality of conduits and one of the first plurality of conduits, allowing the display to be visible through the cover when the light-emitting devices are in the active states, wherein the filling material extends past the inner surface of the cover, such that a portion of each of the first plurality of conduits contains the filling material, and wherein the filling material forms spaced columns extending through the second plurality of conduits and into the first plurality of conduits.

13. The device of claim 12, wherein the filling material provided within a portion of each of the second plurality of conduits is interconnected, such that a layer of filling material is formed below an inner surface of the front piece of the shell.

14. The device of claim 13, wherein the layer of filling material includes a plurality of recesses, wherein each of the plurality of recesses is substantially aligned with one of the plurality of light-emitting devices, such that light emitted from one of the light-emitting devices gathers at the corresponding recess and travels through one of the corresponding second plurality of conduits of the shell.

15. The device of claim 12, wherein the front piece of the shell includes the second plurality of conduits.

16. A device comprising:

a band configured to wrap around a wrist or arm of a user to permit the device to be worn by the user;

an electronic module comprising a computer component and configured for wireless communication with an external device, the electronic module further comprising a plurality of light-emitting devices forming a display controlled by the computer component and configured for selectively displaying human-readable indicia, the display being operable between an active state and an inactive state, wherein each of the light-emitting devices is configured to emit light when in the active state;

a cover comprising a flexible material disposed over the display and covering all of the plurality of light-emitting devices, wherein the flexible material is sufficiently flexible to be bent to an angle of greater than 90 degrees without permanent deformation or fracture, the flexible material having an outer surface and an inner surface opposite the outer surface, the cover further having a first plurality of conduits extending from the inner surface of the cover toward the outer surface through a portion of a thickness of the cover, and wherein each of the first plurality of conduits is substantially aligned with one of the plurality of light-emitting devices; and a rigid shell positioned between a face of the display and the inner surface of the cover, the shell comprising a front piece and a back piece, wherein the front piece of the shell includes a second plurality of conduits, such that each of the second plurality of conduits corresponds to one of the first plurality of conduits, wherein a filling material is provided within a portion of each of the second plurality of conduits, and wherein the shell is configured to permit a portion of the light emitted from each light-emitting device in the active state to pass through, such that light emitted from one of the light-emitting devices travels through one of the corresponding second plurality of conduits and one of the first plurality of conduits, allowing the display to be visible through the cover when the light-emitting devices are in the active states, wherein the filling material provided within a portion of each of the second plurality of conduits is interconnected, such that a layer of filling material is formed below an inner surface of the front piece of the shell, and wherein the layer of filling material includes a plurality of recesses, wherein each of the plurality of recesses is substantially aligned with one of the plurality of light-emitting devices, such that light emitted from one of the light-emitting devices gathers at the corresponding recess and travels through one of the corresponding second plurality of conduits of the shell.

17. A display assembly comprising:

a band having a top portion and curved sides configured to wrap around a wrist or arm of a user to permit the assembly to be worn by the user;

an electronic module comprising a computer component and configured for wireless communication with an external device, the electronic module further comprising a plurality of light-emitting devices forming a display controlled by the computer component and configured for selectively displaying human-readable indicia, the display being operable between an active state and an inactive state, wherein each of the light-emitting devices is configured to emit light when in the active state;

a cover comprising a flexible material disposed over a face of the display and covering all of the plurality of light-emitting devices, such that the flexible material forms an outermost surface of the display assembly, wherein the flexible material is sufficiently flexible to be bent to an angle of greater than 90 degrees without permanent deformation or fracture, the flexible material having an outer surface and an inner surface opposite the outer surface, the cover further having a first plurality of conduits extending from the inner surface of the cover toward the outer surface through a portion of a thickness of the cover, wherein each of the first plurality of conduits is substantially aligned with one of the plurality of light-emitting devices; and a rigid shell positioned between the face of the display and the inner surface of the cover, the shell comprising a front piece and a back piece configured to form an enclosure configured to hold the electronic module, wherein the shell includes a second plurality of conduits, such that each of the second plurality of conduits corresponds to one of the first plurality of conduits, and wherein a filling material is provided within a portion of each of the second plurality of conduits, wherein the filling material provided within a portion of each of the second plurality of conduits is interconnected, such that a layer of filling material is formed below an inner surface of the front piece of the shell, and wherein the layer of filling material includes a plurality of recesses, wherein each of the plurality of recesses is substantially aligned with one of the plurality of light-emitting devices, such that light emitted from one of the light-emitting devices gathers at the corresponding recess and travels through the corresponding second plurality of conduits of the shell.

18. A display assembly comprising:

a band having a top portion and curved sides configured to wrap around a wrist or arm of a user to permit the assembly to be worn by the user;

a display comprising a plurality of light-emitting devices and configured for selectively displaying human-readable indicia, the display being operable between an active state and an inactive state, wherein each of the light-emitting devices is configured to emit light when in the active state;

a cover comprising a flexible material disposed over a face of the display and covering all of the plurality of light-emitting devices, such that the flexible material forms a single, homogenous surface that covers the entire display and extends over the top portion and around the sides of the band, wherein the flexible material is sufficiently flexible to be bent to an angle of greater than 90 degrees without permanent deformation or fracture, the flexible material having an outer surface and an inner surface opposite the outer surface, the cover further having a first plurality of conduits extending from the inner surface of the cover toward the outer surface through a portion of a thickness of the cover, and wherein each of the first plurality of conduits is substantially aligned with one of the plurality of light-emitting devices; and a rigid shell positioned between the face of the display and the inner surface of the cover, the shell comprising a front piece and a back piece configured to form an enclosure configured to hold the display, wherein the front piece of the shell includes a second plurality of conduits, such that each of the second plurality of conduits corresponds to one of the first plurality of conduits, the shell further having a button configured to interact with the display and to provide control operations to the display, and wherein a filling material is provided within a portion of each of the second plurality of conduits, wherein the filling material provided within a portion of each of the second plurality of conduits is interconnected, such that a layer of filling material is formed below an inner surface of the front piece of the shell, and wherein the layer of filling material includes a plurality of recesses, wherein each of the plurality of recesses is substantially aligned with one of the plurality of light-emitting devices, such that light emitted from one of the light-emitting devices gathers at the corresponding recess and travels through the corresponding second plurality of conduit of the shell.

* * * * *